United States Patent [19]

Nepper et al.

[11] Patent Number: 4,494,860

[45] Date of Patent: Jan. 22, 1985

[54] CONTROL CIRCUITRY FOR A CONTINUOUS COPY MACHINE

[75] Inventors: Robert F. Nepper; Alan J. Solyntjes, both of St. Paul, Minn.

[73] Assignee: Minnesota Mining and Manufacturing Company, St. Paul, Minn.

[21] Appl. No.: 518,644

[22] Filed: Jul. 29, 1983

[51] Int. Cl.[3] ..... G03G 15/00

[52] U.S. Cl. ..... 355/13

[58] Field of Search ..... 355/13, 14 R, 29; 83/57, 360, 361

[56] References Cited

U.S. PATENT DOCUMENTS 4,193,330 3/1980 Knox ..... 83/364

4,265,153 5/1981 Price, Jr. ..... 83/372

OTHER PUBLICATIONS

"Continuous Copier" patent application by Robert F. Nepper, Alan J. Solyntjes and Carl W. Abrahamson.

*Primary Examiner*—John F. Gonzales

*Assistant Examiner*—J. Pendegrass

*Attorney, Agent, or Firm*—Donald M. Sell; James A. Smith; David W. Anderson

[57] ABSTRACT

An electrically operated copy machine capable of producing continuous copies of extended length originals is provided with a control switch which allows copying to be stopped at any position along the original and then allows either the copy to be cut and copying discontinued or the repositioning of the original and the continuation of copying at a different portion of the original.

3 Claims, 4 Drawing Figures

CONTROL CIRCUITRY FOR A CONTINUOUS COPY MACHINE

BACKGROUND OF THE INVENTION

1. Field of the Invention

This invention relates generally to roll-fed copying machines and, more particularly, to the apparatus and control circuitry for dispensing cut lengths from a roll of copy sheet material in accordance with varying size originals and wherein a switch responsive to the presence or absence of an original and a manually selected position is used in the control circuitry.

2. Description of the Prior Art

Roll-fed copy machines are known which use one or more switches that are operated in accordance with the presence or absence of original sheets fed into the machine and/or the presence or absence of copy paper for controlling the movement of copy sheet material from a supply and the cutting of the material to length corresponding to the length of the originals. U.S. Pat. No. 4,265,153 issued to Price and assigned to the assignee of the present application, discloses an electrically operated copy machine having a transferring mechanism driven by a drive motor for providing synchronous movement in the copy machine of copy paper and original sheets of varying lengths. The copy paper for the machine is provided by a continuous web of copy paper from a copy paper supply roll. U.S. Pat. No. 4,265,153 provides apparatus and circuitry used in the copy machine which is responsive to the presence and absence of the original sheet for cutting sheets from the copy paper which correspond to the length of the original and includes first and second copy paper feed rollers which are a part of the transferring mechanism. The first feed roller is positioned along the path of travel of the copy paper between the copy paper supply roll and the second feed roller. A solenoid operated cutter is positioned between the first and second feed rollers.

A solenoid controlled clutch is used for operatively connecting the first feed roller to the drive motor. The solenoid is energized only for the time necessary to have the first feed roller move the copy paper from an initial position at the cutter to the second feed roller which then continues to draw copy paper from the copy paper supply roll. Energization of the solenoid for the clutch and the solenoid for the cutter are controlled by a single switch which is positioned along the path of travel of an original sheet presented to the copy machine. The switch has a first and second position, the first position being provided when an original sheet is not presented to the switch with the second position provided when an original sheet is presented to the switch. The first position for the switch is used to complete a first circuit loop which includes a capacitor and the winding of the cutter solenoid. The second position of the switch completes a second circuit loop which includes the winding of the clutch solenoid, the capacitor and a D.C. power supply. Accordingly, the clutch solenoid is operated by the current flow for charging the capacitor when the leading edge of an original is initially detected by the switch to place it in its second position to complete the second circuit loop. The armature of the clutch solenoid is released as the current flow diminishes as the capacitor reaches full charge. When the trailing edge of the original sheet passes the switch, the switch moves to its first position which completes the first circuit loop that includes the capacitor, which is charged, and the winding of the cutter solenoid. This causes the cutter to be operated by discharge of the capacitor via the winding of the cutter solenoid. Accordingly, the cutter solenoid is operated to cut the copy paper to the length of the original sheet presented to the copy machine.

While the foregoing arrangement is entirely effective when the copy machine is used to make copies of standard sized originals, such is not the case when it is desired to make copies of extended length original documents. Since the copy machine is provided with a continuous web of copy paper, it is possible to make copies of documents such as oil well logs or electrocardiagrams which may exceed 100 feet in length. However, it is not always necessary to copy the entire length of such an original document and at times it would be desirable to copy selected, but separated, lengths of such a document onto a continuous sheet of copy paper.

Accordingly, it would be desirable to provide a copy machine such as that described above with means for interrupting the copying of an extended length original and either cutting the copy paper at that point or repositioning the original and continuing copying onto a single sheet of copy paper from the point of interruption.

SUMMARY OF THE INVENTION

Advantageous convenience features are provided by the present invention wherein the above-described copy machine includes a double-pole, triple-throw, manually operated switch, the first pole of which may be placed in a first position to allow the copy machine to operate conventionally as described above, a second position which interrupts the processing of copy paper through the copy machine and allows the switch which senses the absence of the original sheet to be operated without cutting the copy paper and thus permit the original to be lifted and manually advanced, and a third position which energizes the cutter solenoid to cut the copy paper, thus permitting only a portion of the original document to be copied. The second pole of the manually operated switch operatively connects the copy machine's drive motor to a power source when the switch is positioned in its first position and the copy machine is operated conventionally and in its third position to advance the copy through the machine after the copy paper has been cut.

BRIEF DESCRIPTION OF THE DRAWINGS

The present invention will be more thoroughly described with reference to the accompanying drawings wherein like numbers refer to like parts in the several views, and wherein.

DESCRIPTION OF THE PREFERRED EMBODIMENT

Figure 1:
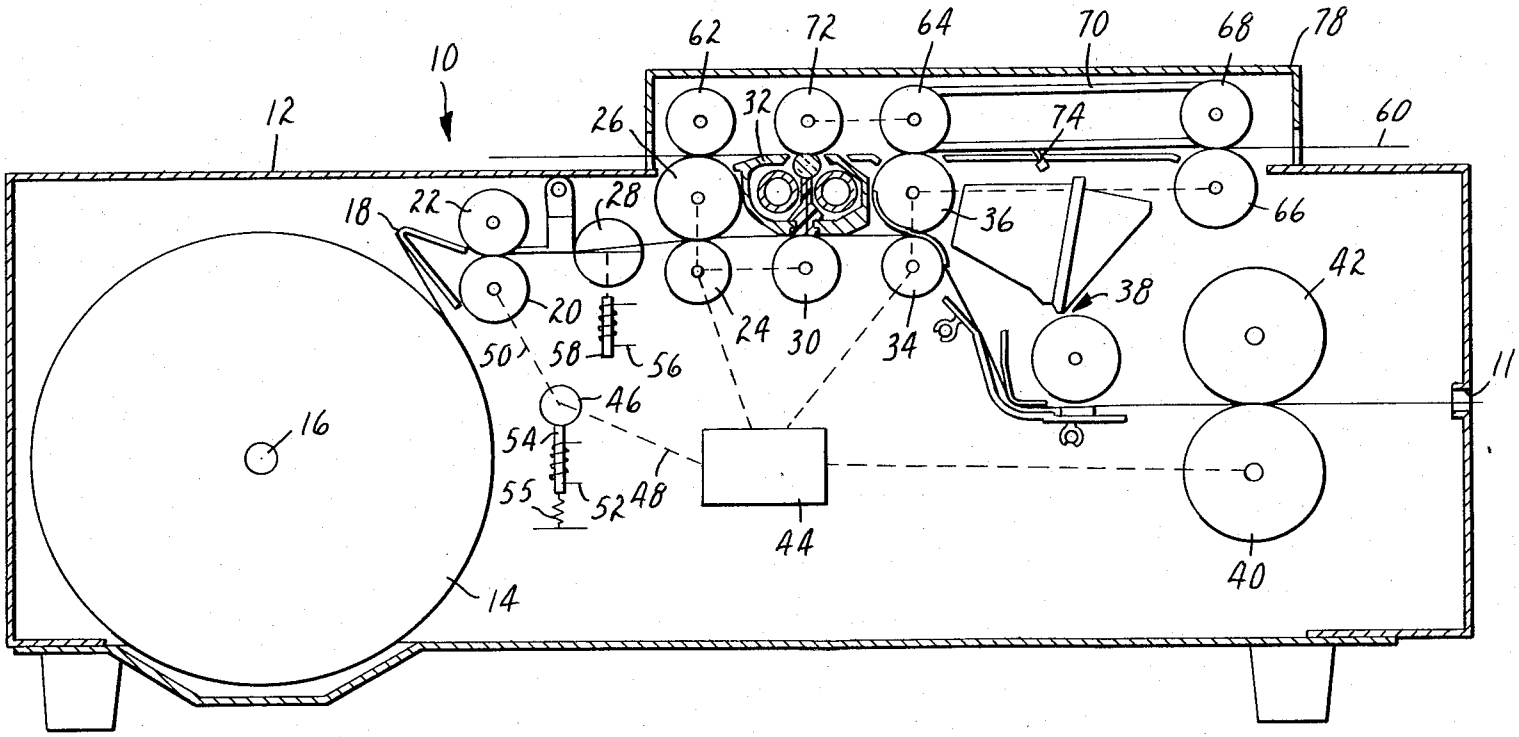
FIG. 1 PRIOR ART
FIG. 1 is a diagrammatic side elevational view of an existing electrically operated copying machine.
Figure 2:
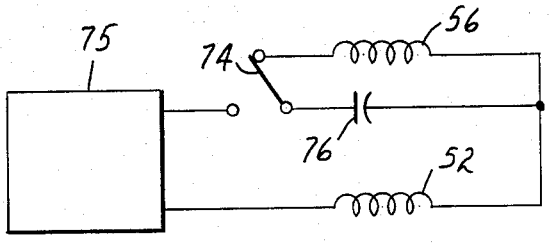
FIG. 2 PRIOR ART
FIG. 2 is a schematic diagram of the control circuitry of the existing copy machine of FIG. 1.

For a complete understanding of the invention, a detailed description of an existing copy machine and its associated control circuitry, as depicted in FIGS. 1 and 2, is necessary.

Referring to FIG. 1, a diagrammatic side elevational view of an electrically operated copy machine 10 is shown which includes a housing 12 in which a copy paper supply roll 14 is positioned for rotation counterclockwise about an axle for the roll indicated at 16. For the type of copy machine to be described, the copy paper is a zinc oxide coated paper such as that available from the Minnesota Mining and Manufacturing Company of St. Paul, Minn. under the designation Type 470. The copy paper is moved through the copy machine 10 by a transferring mechanism which includes a first feed roller 20 which receives the copy paper from the supply roll 14 via a guide member 18, an idler roller 22 above the roller 20 between which the copy paper is moved when the roller 20 is driven, a second feed roller 24 and a cooperating charge roller 26 positioned above the roller 24 which also serves to place a uniform electrical charge on the zinc oxide surface of the copy paper, a roller 30 which receives the copy paper from the rollers 24 and 26 and keeps it in close contact with the exposure station, indicated generally at 32, a drive roller 34 plus a roller 36 positioned above the roller 34 which receive the paper from the roller 30 and move it past a developer station, indicated generally at 38, and a driven pressure roller 40 and a cooperating idler roller 42 positioned above the roller 40 which receive the copy paper from the rollers 34 and 36 and move the copy paper via an opening 11 in the housing 12 to an area outside of the housing. The path taken by the copy paper is shown by the solid line that extends from the copy paper supply roll 14 to the right side of the housing.

A drive motor 44 is also a part of the transferring mechanism and provides the driving force for the transferring mechanism. A direct drive connection, indicated by dotted lines, is provided between the drive motor 44 and the feed roller 24, the drive roller 34 and the roller 40. A chain drive (not shown) may be used to provide the direct drive connection. The drive motor 44 is also operatively connected to drive the feed roller 20 via a solenoid operated feed clutch 46 as indicated by the dotted line 48 between the motor 44 and the clutch 46 and the dotted line 50 between the clutch 46 and feed roller 20. The drive relationship between the clutch 46 and the motor 44 and between the clutch 46 and the feed roller 20 is only diagrammatically shown.

The clutch 46 may be a spring clutch available from the PSI Division of Warner Electric Brake and Clutch Company, Pittman, N.J., under stock number 501581. The clutch 46 is controlled by a solenoid which includes a winding 52 and an armature 54, which by a spring 55 is biased toward the clutch 46. When the winding 52 is energized, the armature 54 moves allowing the clutch 46 to couple the drive motor 44 to the feed roller 20. If the winding 52 is de-energized before the clutch 46 rotates one revolution, the clutch 46 is engaged by the armature 54 to terminate movement of the roller 20 after one revolution of the clutch. As will be explained later, one revolution of roller 20 is required when making a copy using the machine 10 shown in FIG. 1.

A solenoid controlled cutter 28 is provided along the path of the copy paper and is positioned between the first feed roller 20 and the second feed roller 24. Normally, the copy paper will be at the cutter 28 after a copy has been made with the cutter bar portion of the cutter 28 positioned to allow paper to move to the second feed roller 24 when the first feed roller 20 is driven. The spacing between the cutter 28 and the roller 24 is such that only one revolution of the feed roller 20 is required to bring the copy paper to the second feed roller 24. The solenoid for the cutter 28 includes a winding 56 and an armature 58 which is operatively connected, as indicated by the dotted line, to the cutting bar portion of the cutter 28. The cutter 28 is moved to the cutting position when the winding 56 is energized and returns to its original position when the winding 56 is de-energized to cause the armature 58 to return to the de-energized position. Solenoid controlled cutters of the type described for severing paper presented to it from a feed roller are well known in the art.

It is necessary when making a copy of an original sheet that movement of the original sheet and the copy paper be synchronized so their leading edges reach the exposure station 32 at the same time. The transferring mechanism of the copy machine 10 that serves to provide such movement of an original sheet includes a portion of the transferring mechanism used in moving copy paper through the machine. An original passes in FIG. 1 from right to left along the path indicated by the line 60.

The charge roller 26 and the feed roller 24, which are used in the transferring mechanism for the copy paper, are also used directly as part of the transferring mechanism for the original sheets presented to the copier. The roller 24 is coupled, as indicated by the dotted line, to drive the charge roller 26. Gears can be used to provide the coupling. An idler roller 62 is positioned above and cooperates with the roller 26. A similar coupling arrangement is provided between the rollers 34 and 36 with a roller 64 positioned above the roller 36 to drive the original. The roller 36 is also coupled, as indicated by the dotted line, to drive a feed roller 66 positioned at the right portion of the machine 10 where an original is initially inserted. The roller 36 may be coupled to the feed roller 66 by a timing belt (not shown). The feed roller 66 has a roller 68 positioned above it which is coupled to the roller 64 by a number of o-ring belts 70 (only one is shown) positioned along the rollers 68 and 64. A roller 72 is positioned adjacent the exposure station 34 opposite the roller 30. The roller 72 is biased toward the exposure station and is a driven roller being coupled, as indicated by the dotted line, to the roller 64. Such coupling can be provided by a timing belt (not shown). With the drive motor 44 for the transferring mechanism operating, the portion of the transferring mechanism just described is effective to move an original sheet along the path indicated by the line 60 and carry the original past the exposure station 32 to an exit point to the left of the rollers 26 and 62.

A snap-acting type switch 74 of the single-pole, double-throw configuration, is positioned in the flow path of the original. A switch of this type is well known and commercially available from several sources. The switch 74 is operated by the leading edge of an original sheet and is positioned so its actuation in response to the leading edge occurs when the leading edge is at a distance from the center of the exposure station 32 that is equal to the distance that the leading edge of the copy paper, which is at the cutter 28, travels to reach the center of the exposure station 32 following energization of the winding 52. As will be explained, the actuation of switch 74 in response to the leading edge of the original is effective to energize the winding 52 of the solenoid of the clutch 46 to release the clutch 46 and allow the feed roller 20 to be driven. As will be explained, the armature 54 of the solenoid of the clutch 46 is released since current to the solenoid is reduced before the feed roller 20 has rotated a full revolution allowing the armature 54 to stop operation of the clutch 46.

A control circuit utilizing the switch 74 is shown in FIG. 2. The position in which the switch 74 is shown shall hereinafter be referred to as the first position. It is the position the switch automatically assumes when it is not responding to the presence of an original sheet. The other position, which is assumed by the switch 74 when responding to an original sheet, shall hereinafter be referred to as the second position. The control circuit includes a D.C. power supply 75 which has one output connected to the fixed contact of the switch 74 associated with the second position of the switch 74. The fixed contact of the switch 74 associated with the first position of the switch 74 is connected to one end of the winding 56 for the cutter solenoid. The other end of the winding 56 is connected to one end of the winding 52 of the solenoid of the feed clutch 46. The other end of the winding 52 is connected to the other output of the D.C. power supply 75. A capacitor 76 is connected between the movable contact of the switch 74 and the connection common to the windings 52 and 56. When the switch 74 is in its first position a first circuit loop including the winding 56 and the capacitor 76 is completed. When the switch 74 is in its second position, a second circuit loop is completed which includes the D.C. power supply 75, the capacitor 76 and the winding 52.

Operation of the circuit of FIG. 2 in conjunction with movement of the copy paper and an original sheet through the copy machine 10 will be described. Prior to the insertion of an original sheet into the copy machine 10, the circuit of FIG. 2 is as shown, wherein each of the windings 52 and 56 is de-energized so the leading edge of the copy paper is at the cutter 28 where it remains until the clutch 46 is released by energization of the solenoid winding 52 to cause the feed roller 20 to be driven. Assuming the drive motor 44 is energized, the original sheet is carried by the rollers 66 and 68 and the o-ring belts 70 toward the snap switch 74. Upon actuation of the switch 74 to its second position by the leading edge of the original sheet, the second circuit loop is established. This causes the winding 52 of the clutch solenoid to be energized by the D.C. current flow established for charging the capacitor 76. With the clutch solenoid winding 52 energized, the clutch 46 is released causing the drive motor 44 to drive the feed roller 20 to move the leading edge of the copy paper toward the driven feed roller 24. The current flow for charging the capacitor 76 becomes less as the capacitor 76 approaches full charge causing the armature 54 of the clutch solenoid to return to its de-energized position. The time for charging the capacitor 76 is short enough that the return of the armature 54 to its de-energized position occurs before the roller 20 has made one revolution to cause the armature of the solenoid to disengage the clutch 46 from the roller 20 upon completion of one revolution of roller 20. The spacing of the rollers 24 and 26 from the cutter 28 is such that one revolution of the roller 20 is sufficient to move the leading edge of the copy paper from the cutter 28 to the rollers 24 and 26 so movement of the copy paper is continued by the rollers 24 and 26 following disengagement of the clutch 46 from the roller 20.

Movement of the copy paper via the rollers 24 and 26 and the original sheet via the rollers 66 and 68 plus the rollers 36 and 64 causes both leading edges to reach the center of the exposure station 32 at the same time. This causes a latent image to be defined by an electrical charge on the copy paper in accordance with the light energy directed from the original sheet to the copy paper via the exposure station 32. During further travel, the copy paper proceeds via the rollers 34 and 36 past the developer station 38, where toner is deposited on the copy paper in accordance with the charge image, to the pressure fuser station provided by the rollers 40 and 42 where the toner image is fused to the copy paper by pressure.

When the trailing edge of the original sheet passes the switch 74, the switch 74 returns to its first position to complete the first circuit loop. The charged capacitor 76 is discharged via the winding 56 of the cutter solenoid causing the cutter 28 to be operated to sever the copy paper at the cutter 28 allowing the severed portion, which is cut to the length of the original sheet presented to the copy machine 10, to complete its path through the copy machine 10 in synchronism with passage of the original sheet through the copy machine 10.

The above description refers specifically to operation of the copy machine 10 when used to copy standard sized documents, usually not in excess of 14 inches. With minor modifications, which do not form a part of this invention and are not shown, the copy machine 10 is capable of producing continuous copies of original documents, such as oil well logs or electrocardiagrams, which may exceed 100 feet in length. If it is desired to produce a continuous copy of the complete length of such an extended-length original, the copy machine 10 will operate as described above.

However, it is not always desirable to copy the entire length of such a document and it may be desirable to copy distinct and separated portions of an extended-length original onto a continuous length of copy paper. A feature not described above of the copy machine 10 is that the rollers 62, 64, 68 and 72 and the belt 70 which drive the original past the exposure station 32 are contained within and attached to a cover 78 which is pivotally attached to the housing 12 and which may be released to carry the rollers 62, 64, 68 and 72 and the belt 70 out of contact with the original.

If it were desired to produce a copy of only a portion of an original document, it would be possible, therefore, to lift the cover 78 after the desired portion of the original has passed the exposure station 32. Lifting of the cover 78 would remove the original from the switch 74 and allow the switch 74 to return to the first position as illustrated by FIG. 2. The return of the switch 74 to this first position would result in cutting of the copy paper as described above.

Lifting of the cover 78, however, is not a convenient way to terminate copying; and cutting of the copy after partially copying the original may not always be desired. The operator may desire to copy a subsequent section of the original onto the same sheet of copy paper used to copy the previous section.

Figure 3:
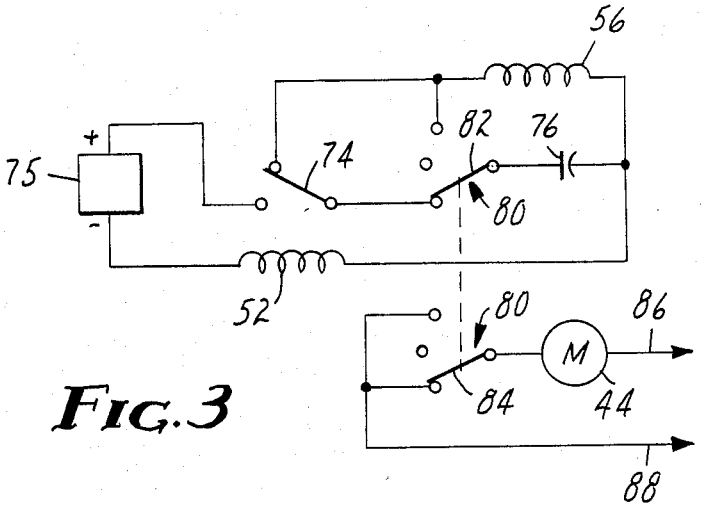
FIG. 3 is a schematic diagram of the control circuitry of the present invention.
Figure 4:
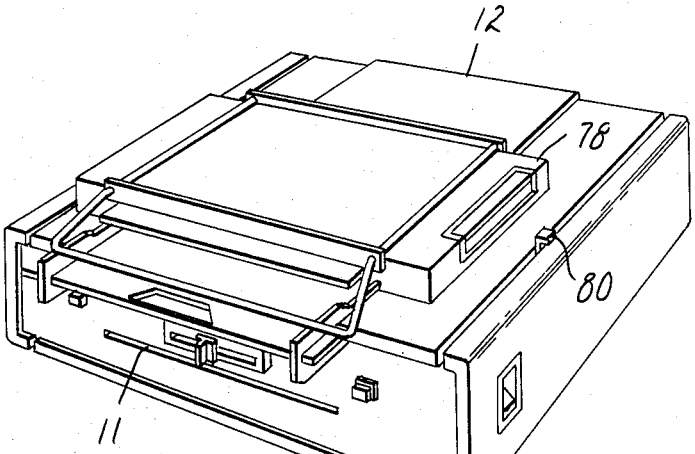
FIG. 4 is a perspective view of a copy machine embodying the present invention.

The addition of a double-pole, triple-throw, manually operated switch 80 to the circuitry of FIG. 2, as illustrated schematically in FIG. 3 and located as shown in FIG. 4, allows the operator either to copy only a portion of an extended length original and cut the copy paper or to copy a portion of the original, stop the copying process, reposition the original and continue copying onto the same sheet of copy paper a separate portion of the original.

A control circuit utilizing the switch 80 is shown in FIG. 3. The position in which the switch 80 is shown shall hereinafter be referred to as the first position. It is the position in which the fixed contact associated with this position is connected to the movable contact of the switch 74. The center position of the switch 80, in which the fixed contact is not connected, will be hereinafter referred to as the second position. The remaining position of the switch 80, in which the fixed contact is connected to the side of the winding 56 which connects to the fixed contact associated with the first position of the switch 74, shall hereinafter be referred to as the third position. The movable contact of the switch 80 is connected to that side of the capacitor 76 which was previously connected to the movable contact associated with the switch 74.

When the switch 80 is in its first position, the capacitor 76 and the switch 74 are connected as described with respect to FIG. 2. The first position of the switch 80 thus allows the control circuit to operate as described with respect to FIG. 2 in which the feed solenoid winding 52 and the capacitor 76 are connected to the power supply 75 to form the second circuit loop when an original is presented to the switch 74 and the capacitor 76 is connected to the winding 56 to form the first circuit loop when the original passes out of contact with the switch 74.

The second position of the switch 80 disconnects the capacitor 76 from the switch 74 and disables the switch 74 from completing either of the first or second circuit loops. Thus, when the switch 80 is in the second position, the copy paper will neither be cut nor will copy paper be fed to the rollers 24 and 26.

When the switch 80 is in the third position, a third circuit loop is formed which includes the capacitor 76 and the winding 56 of the cutter solenoid.

In addition to the first pole 82, the switch 80 includes a second pole 84 which moves in response to movement of the first pole 82. The second pole 84 operates to connect the drive motor 44 to a power source, indicated by the arrows 86 and 88, when the switch 80 is positioned in either of its first or third positions and to disconnect the motor 44 from its power supply 86, 88 when the switch 80 is located in its second position.

Operation of the circuit of FIG. 3 in conjunction with movement of the copy paper and original sheet through the copy machine 10 will be described. Prior to the insertion of an original sheet into the copy machine 10, the circuit of FIG. 3 is as shown, wherein the switch 74 assumes its first position in response to the absence of an original sheet and the switch 80 has been manually positioned in its first position. Each of the windings 52 and 56 is de-energized so the leading edge of the copy paper is at the cutter 28 where it remains until the clutch 46 is engaged by energization of the solenoid winding 52 to cause the feed roller 20 to be driven. Since the drive motor 44 is connected to its power supply 86, 88 by the second pole of the switch 80, an inserted original will be carried by the rollers 66 and 68 and the o-ring belts 70 toward the snap switch 74. Upon actuation of the switch 74 to its second position by the leading edge of the original sheet, the second circuit loop is established. This causes the winding 52 for the feed clutch solenoid to be energized by the D.C. current flow established for charging the capacitor 76. With the feed clutch solenoid winding 52 energized, the clutch 46 is engaged causing the drive motor 44 to drive the feed roller 20 to move the leading edge of the copy paper toward the driven feed roller 24. The current flow for charging the capacitor 76 becomes less as the capacitor 76 approaches full charge causing the armature 54 of the clutch solenoid to return to its de-energized position. Copying of the original will then proceed as described above with respect to the control circuit of FIG. 2.

If it is desired to copy only a portion of the original, the switch 80 is manually moved to its second position, wherein the first pole 82 of the switch 80 disconnects the capacitor 76 from the movable contact of the switch 74 and the second pole 84 of the switch 80 disconnects the motor 44 from its power supply 86, 88. Progress of the copy paper through the copy machine 10 will thus be stopped because the motor 44 is not connected to its power supply 86, 88 and the switch 74 is disabled from completing either of the first or second circuit loops. Thus the cover 78 may be lifted and the original sheet either removed or repositioned without energization of the winding 56 and subsequent operation of the cutter 28.

If it is desired to stop copying and remove the original, the switch 80 is manually moved to its third position wherein the first pole 82 of the switch 80 forms the third circuit loop which includes the capacitor 76 and the winding 56 which operates the cutter 28 to cut the copy paper. Simultaneously, when the first pole 82 of the switch 80 is moved to its third position, the second pole 84 of the switch 80 is likewise moved to its third position wherein the motor 44 is connected to its power supply 86, 88 to transport that portion of the copy paper forward of the cutter 28 through and out of the copy machine 10. The switch 80 is then manually repositioned in first position to begin another cycle.

If it is desired to reposition the original and continue copying at a different section of the original, the switch 80 is left in its second position until the original is repositioned as desired and the cover 78 is closed. The switch 80 is then manually repositioned to its first position and copying will recommence and continue until either the end of the original is reached or copying is again stopped by moving the switch 80 to its second position. When the original is repositioned and the cover 78 is reclosed, the switch 74 will be in its second position and movement of the switch 80 to its first position will complete the second circuit loop which includes the D.C. power supply 75, the capacitor 76 and the feed clutch solenoid winding 52. Completion of this second circuit loop will restore any dissipated charge on the capacitor 76 and may energize the clutch solenoid winding 52, but since the copy paper is already moving through the copy machine 10 because the motor 44 is connected to its power supply 86, 88, energization of the clutch solenoid winding 52 will have no effect on the operation of the copy machine 10.

Thus, the addition of the switch 80 to the control circuitry of FIG. 2 permits the copying of an extended length original to be stopped at any position along the original and then permits either the copy to be cut and copying discontinued or the repositioning of the original and the continuation of copying at a different portion of the original.

A copy machine 10 which will produce extended length continuous copies of exceptionally long original sheets has been described with respect to certain particular embodiments. It is expected that modifications of these specific embodiments will be apparent to those skilled in the art. Such modifications are intended to be considered a part of this invention if they fall within the scope of the appended claims.

What is claimed is:

1. An electrically operated copy machine having a transferring mechanism driven by a drive motor for providing synchronous movement in the copy machine of copy paper and original sheets of varying lengths where the copy paper is provided by a continuous web of copy paper from a copy paper supply roll and apparatus and circuitry responsive to the presence and absence of the original for cutting sheets from the copy paper which correspond to the length of the original including:

first and second copy paper feed rollers included in the transferring mechanism, said first feed roller positioned between the copy paper supply roll and said second feed roller;

first and second solenoids, each having a winding;

a capacitor having one side connected to one end of each of said windings;

a D.C. power supply having one side connected to the other end of said second solenoid winding;

a cutter positioned in the path of travel of the copy paper between said first and second feed rollers and operatively connected to said first solenoid;

first switch means positioned along the path of travel for an original sheet presenting a first position and a second position in response to the absence and presence, respectively, of an original sheet presented to the copy machine at said first switch means, said first switch means operatively connected to said other end of said first solenoid winding, the other side of said capacitor and the other side of said D.C. power supply forming a first circuit loop including said first solenoid winding and said capacitor when said switch means is presenting said first position and forming a second circuit loop including said D.C. power supply, said capacitor and said second solenoid winding when said switch means is presenting said second position, said second circuit loop when formed causing said capacitor to be charged and causing said second solenoid winding to be energized while said capacitor is being charged and said first circuit loop when formed subsequent to the formation of said second circuit loop causing said first solenoid winding to be energized by the discharge of said capacitor;

a clutch adapted for control by said second solenoid and operatively engaged between the drive motor and said first feed roller for providing sufficient rotation of said first feed roller to move the copy paper from said cutter to said second feed roller following energization of said second solenoid; and manually operated second switch means including a first pole presenting a first, a second and a third position and a second pole presenting a first, a second and a third position, said first pole being operatively connected between said first switch means and said other side of said capacitor and to said other side of said first solenoid winding forming a connection between said other side of said capacitor and said first switch means to enable said first switch means to form said first or second circuit loops when said second switch means is presenting said first position, disconnecting said other side of said capacitor and said first switch means to disable said first switch means from forming said first and second circuit loops when said second switch means is presenting said second position and forming a third circuit loop including said first solenoid winding and said capacitor when said second switch means is presenting said third position, said third circuit loop when formed subsequent to the formation of said second circuit loop causing said first solenoid winding to be energized by the discharge of said capacitor, said second pole of said second switch means being adapted to operatively connect said drive motor to a power supply when presenting said first and third positions and disconnecting said drive motor from said power supply when presenting said second position.

2. An electrically operated copy machine in accordance with claim 1 wherein said first switch means is a single-pole, double-throw type.

3. An electrically operated copy machine in accordance with claim 1 wherein said second switch means is a double-pole, triple-throw type.

* * * * *